US009935360B2

(12) United States Patent
Mai et al.

(10) Patent No.: US 9,935,360 B2
(45) Date of Patent: Apr. 3, 2018

(54) MOBILE PHONE ANTENNA STRUCTURE WITH FULL SPECTRUM BAND

(71) Applicants: Jianchun Mai, Shenzhen (CN); Renkai Li, Shenzhen (CN)

(72) Inventors: Jianchun Mai, Shenzhen (CN); Renkai Li, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 15/358,735

(22) Filed: Nov. 22, 2016

(65) Prior Publication Data

US 2018/0006361 A1 Jan. 4, 2018

(30) Foreign Application Priority Data

Jul. 1, 2016 (CN) ..... 2016 2 0689131 U

(51) Int. Cl.

| | |
|---|---|
| ***H01Q 1/38*** | (2006.01) |
| ***H01Q 1/24*** | (2006.01) |
| ***H01Q 1/48*** | (2006.01) |

(52) U.S. Cl.
CPC ..... *H01Q 1/243* (2013.01); *H01Q 1/38* (2013.01); *H01Q 1/48* (2013.01)

(58) Field of Classification Search
CPC ..... H01Q 1/243; H01Q 1/38; H01Q 1/48
USPC ..... 343/702
See application file for complete search history.

*Primary Examiner* — Andrea Lindgren Baltzell
(74) *Attorney, Agent, or Firm* — Pro, PLLC; Na Xu

(57) ABSTRACT

An antenna structure includes a metal shell including a grounded middle frame provided with a main body and sides bent and extending from two sides of the main body and a radiating part serving as an antenna radiating body. The radiating part forms an insulation filled gap with the middle frame. Two ends of the radiating part are arranged opposed to each other for forming an insulation filled breaking joint. A circuit board is arranged below the metal shell, and one side of the circuit board adjacent to the radiating part forms a clearance zone between the circuit board and the radiating part. The antenna further includes a feeding point, at least one ground point, and a tuning circuit. The feeding point is close to the breaking joint, and the ground point includes a first ground point and a second ground point.

4 Claims, 2 Drawing Sheets

MOBILE PHONE ANTENNA STRUCTURE WITH FULL SPECTRUM BAND

FIELD OF THE INVENTION

The present disclosure relates to an antenna structure, and particularly relates to a mobile phone antenna structure with full spectrum band.

DESCRIPTION OF RELATED ART

In a prior art, with regard to the realization of an antenna with an all-metal shell, three-phase slotting should be generally carried out on a metal shell, that is to say, two grooves arranged in parallel are formed on the metal shell, to divide the metal shell into an earthed middle frame and a radiating part located at two sides of the middle frame. And even, windowing should be added to become a five-phase structure, and such design damages the integrity of the metal shell and goes against the beauty. Moreover, due to the cause of an internal environment and clearance of a mobile phone, it is relatively difficult to realize that the carrier aggregation of an existing mobile phone antenna covers full spectrum band in a state, because the bandwidth is insufficient, and the resonance point is few.

Therefore, it is necessary to provide a new mobile phone antenna structure with full spectrum band.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to an exemplary embodiment. To make the technical problems to be solved, technical solutions and beneficial effects of the present disclosure more apparent, the present disclosure is described in further detail together with the figures and the embodiment. It should be understood the specific embodiment described hereby is only to explain this disclosure, not intended to limit this disclosure.

Figure 1:
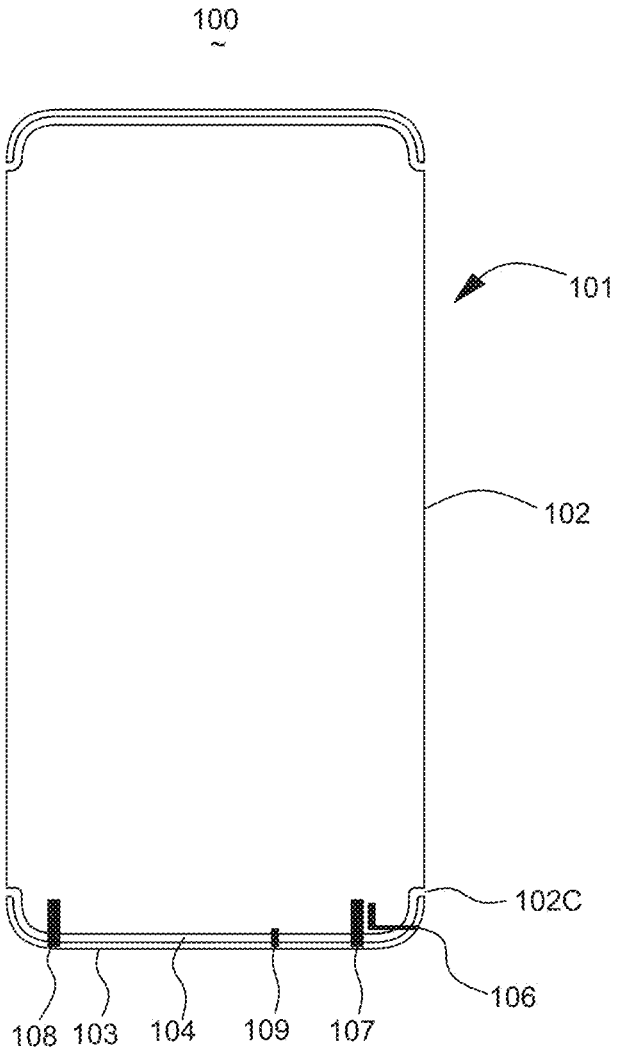
FIG. 1 is a top view of a mobile phone antenna structure in accordance with an exemplary embodiment of the present disclosure.
Figure 2:
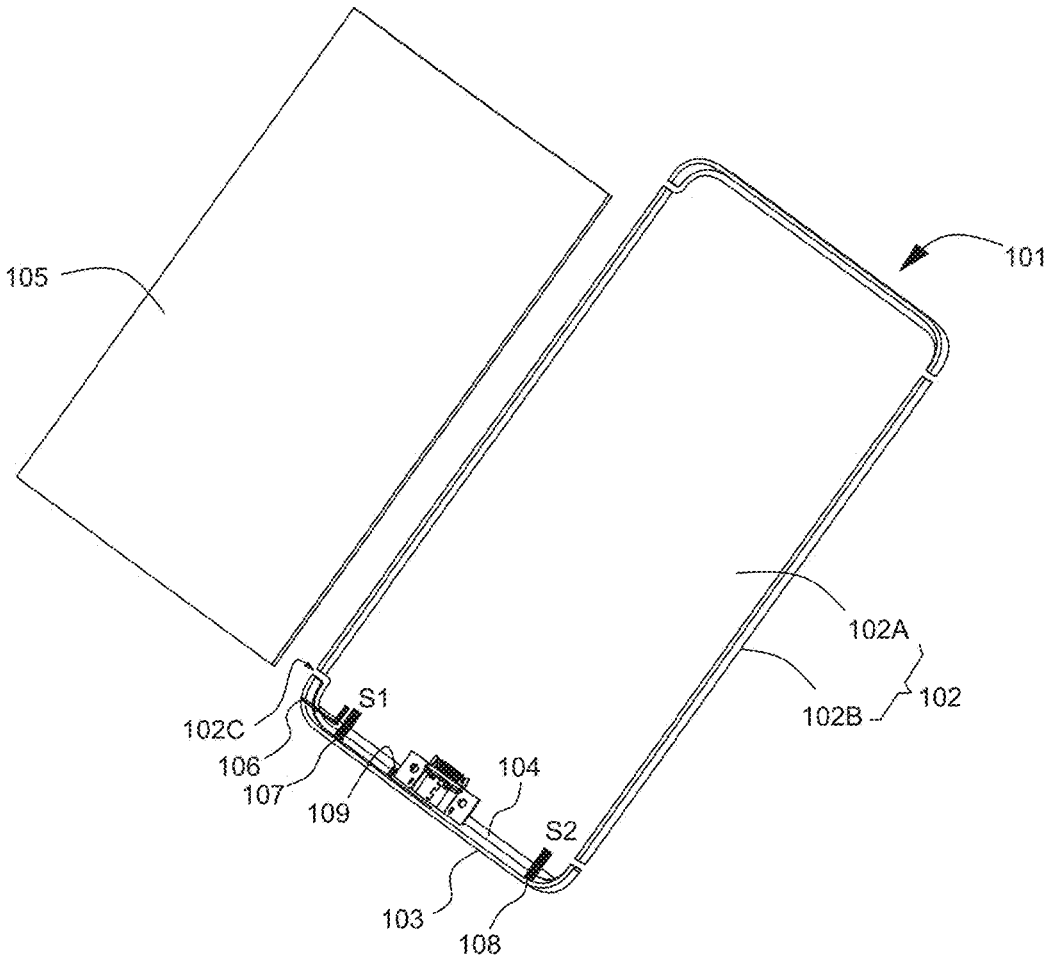
FIG. 2 is an exploded view of the mobile phone antenna structure in FIG. 1.

As shown in FIGS. 1-2, a mobile phone antenna structure 100 with full spectrum band comprises a metal shell 101 and a circuit board 105.

The metal shell 101 comprises a grounded middle frame 102 and a radiating part 103 as an antenna radiating body. The middle frame 102 is provided with a main body 102A and sides 102B bent and extended from two sides of the main body 102A. The radiating part 103 is located at the bottom of the middle frame 102 and forms an insulated filled gap 104 with the middle frame 102, and two ends of the radiating part 103 are relative to the ends of the two sides 102B respectively and arranged at intervals to form an insulated filled breaking joint 102C. One side that the circuit board 105 is close to the radiating part 103 is parallel to the edge of the middle frame 102, thus, a clearance zone is formed between the circuit board 105 and the radiating part 103. The gap 104 is connected to the breaking joint 102C, and the width of the gap and the breaking joint shall not be more than 1.5 mm as far as possible. And the gap 104 and the breaking joint 102C are filled with insulating materials. As the gap and the breaking joint are arranged by closing to the metal shell 101, the integrity of the metal shell 101 is not damaged.

The mobile phone antenna structure 100 with the full spectrum band further comprises a feeding point 106 arranged on the radiating part 103 and at least one ground point. The feeding point 106 is arranged by closing to the breaking joint 102C. In the present disclosure, the ground point comprises a first ground point 107 close to the feeding point 106, a second ground point 108 far from the feeding point 106 and a third ground point 109 located between the first ground point 107 and the second earth joint 108. The first ground point 107 and the second ground point 108 are located at the same side of the feeding point 106. The circuit board 105 directly feeds the feeding point 106 on the radiating part 103 through a conductor. The first ground point 107, the second ground point 108 and the third ground point 109 are directly in electrical connection with the earthed middle frame 102 through the conductor.

In addition, the mobile phone antenna structure 100 with the full spectrum band further comprises a tuning circuit. The tuning circuit comprises a first inductor and a second inductor parallel to each other, and a first switch S1 which is capable of switching over between the first inductor and the second inductor. The first switch S1 can control whether the first inductor and the second inductor are electrically connected with the first ground point 107. The tuning circuit further comprises a first capacitor and a second switch S2 controlling whether the first capacitor is electrically connected with the second ground point 108. In the present disclosure, a first inductance value is 22 nH, a second inductance value is 9 nH, and a first capacitance value is 1.5 pF.

When the first inductor is electrically connected with the first ground point 107 through the first switch S1 and the second switch S2 is off-state, the radiation frequency of the mobile phone antenna structure with the full spectrum band is 700-824 MHz.

When the second inductor is electrically connected with the first ground point 107 through the first switch S2 and the second switch S2 is off-state, the radiation frequency of the mobile phone antenna structure with the full spectrum band is 824-960 MHz.

When the first capacitor is electrically connected with the first ground point 107 through the first switch S2 and the second switch S2 is in a closed state, the radiation frequency of the mobile phone antenna structure with the full spectrum band is 1710-2690 MHz.

Therefore, the high and low frequency can be switched over by virtue of the switch S1 and S2; and the low frequency can be covered by two states for 700-960 MHz, and the efficiency is basically more than 30%. The medium and high frequency can be covered by one state, and the efficiency is basically more than 25%, which can meet the requirement that the carrier aggregation covers the full spectrum band in one state.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A mobile phone antenna structure with full spectrum band, comprising:

a metal shell including a grounded middle frame provided with a main body and sides bent and extending from two sides of the main body and a radiating part serving as an antenna radiating body, the radiating part located at one end of the middle frame and forming an insulation filled gap with the middle frame;

two ends of the radiating part being corresponding to the ends of the sides respectively and arranged opposed to each other for forming an insulation filled breaking joint;

a circuit board arranged below the metal shell, and one side of the circuit board adjacent to the radiating part being parallel to an edge of the middle frame for forming a clearance zone between the circuit board and the radiating part;

a feeding point arranged above the radiating part;

at least one ground point;

a tuning circuit; wherein the feeding point is arranged close to the breaking joint, and the ground point comprises a first ground point close to the feeding point and a second ground point far from the feeding point.

2. The mobile phone antenna structure with the full spectrum band as described in claim 1, wherein the first ground point and the second ground point are located at the same side of the feeding point.

3. The mobile phone antenna structure with the full spectrum band as described in claim 1, wherein each of the gap and the breaking joint has a width not more than 1.5 mm.

4. The mobile phone antenna structure with the full spectrum band as described in claim 2, wherein the tuning circuit comprises a first inductor, a second inductor, a first capacitor, a first switch, and a second switch, wherein the first inductor, the second inductor and the first capacitor are parallel to one another; the first switch can be switched over among the first inductor, the second inductor and the first capacitor and electrically connected with the first ground point, and the second switch is used for controlling whether the second ground point is grounded.

* * * * *